United States Patent [19]

Soto

[11] 4,102,487

[45] Jul. 25, 1978

[54] DISPOSABLE RESEALABLE CONTAINER

[76] Inventor: Ricardo Hurtado Soto, Apartado 91711, Bogota, Colombia

[21] Appl. No.: 794,005

[22] Filed: May 5, 1977

[51] Int. Cl.[2] ..... B65D 33/02; B65D 33/06; B65D 33/16

[52] U.S. Cl. ..... 229/54 R; 150/7; 150/25; 224/45 P; 224/52; 229/55; 229/62

[58] Field of Search ..... 229/54 R, 62, 55; 150/3, 12, 7, 25; 24/16 R, 17 A, 30.5 R; 224/45 BA, 45 H, 45 P, 52, 54

[56] References Cited

U.S. PATENT DOCUMENTS

| | | | |
|---|---|---|---|
| 1,876,231 | 9/1932 | Hume | 24/30.5 R |
| 2,309,315 | 1/1943 | Hirsch | 24/30.5 R |
| 2,643,424 | 6/1953 | Gothar | 24/17 A |
| 3,027,066 | 3/1962 | Vineberg | 229/54 R |
| 3,200,868 | 8/1965 | Strayer | 150/7 |
| 3,268,151 | 8/1966 | Soto | 229/62 |
| 3,299,927 | 1/1967 | Clarizio | 229/62 X |

*Primary Examiner*—Stephen P. Garbe
*Attorney, Agent, or Firm*—Emrich, Root, O'Keefe & Lee

[57] ABSTRACT

A sealable container includes a pleated bag with a stiffener member attached adjacent but spaced from its mouth so that items may be placed in the bag, the pleats folded to close it, and the upper portion folded over the stiffener to seal it. A back is drawn about the folded upper portion and connected to the stiffener to seal the bag. The stiffener also provides a handle for carrying.

7 Claims, 10 Drawing Figures

DISPOSABLE RESEALABLE CONTAINER

BACKGROUND AND SUMMARY

The present invention relates to an inexpensive, yet sturdy container that may be used several times before discarding. Such containers are particularly suited for use by travelers or the like or by more expensive gift shops where the size of the container chosen depends upon the particular item being carried.

As such, the invention represents an improvement over the device disclosed in my U.S. Pat. No. 3,268,151 entitled "Bag Closure" which disclosed a flexible bag adapted to have its mouth folded and doubled through a flexible tubular closure having two separate passages arranged side-by-side. A first folded portion of the bag was positioned in one passage of the closure and the second folded portion was positioned in the other passage; and a fastener was extended through both folded portions and the tubular closure to hold the bag in a sealed condition. Thus, the closure member was a separate element, not ordinarily attached to the bag except for sealing.

In the present invention, a sealable container includes a bag having flat front and back panels and first and second pleated sides joined to the front and back panels. An elongated stiffener member is attached to the front panel a short distance beneath the mouth of the bag. The stiffener is preferably attached by folding the upper portion of the front panel over the stiffener member and attaching it to itself along a glue line, if thermoplastic materials are used, by heat sealing.

The stiffener member is provided with a handle which extends through a die-cut in the folded portion. The stiffener member is long enough to extend beyond the front panel of the bag, and thereby defines first and second slotted extensions. The stiffener member is also provided with a stud or protrusion with an enlarged head or button.

A flexible band or belt extends about the back panel and pleated sides of the bag and has ends fitted through the slots on the band extensions.

Thus, the bag may be held by the handle while inserting items into it; and the stiffener member acts to keep the bag supported and the mouth generally formed to facilitate insertion of items. Further, the band is dimensioned to permit the bag of the mouth to be fully opened, yet to restrain further opening of the bag which might cause tearing.

When items have been inserted into the bag, the pleated sides are folded to close the mouth of the bag, and the upper portion of the bag above the stiffener is folded over the stiffener member to seal the bag. The free ends of the band are then drawn around the folded portion of the bag and attached to the beaded stud on the stiffener to secure the bag. If it is desired, a slip of paper may be secured to the beaded stud prior to securing the free ends of the band, and after the free ends of the band are then secured to the beaded stud, the upper end of the paper may be sealed to itself, thereby enveloping the locked ends of the band and providing a seal which must be destroyed before the bag is re-opened. The seal may be replaced during subsequent usage.

The present invention thus provides an inexpensive, resealable container that may be used several times before discarding. The same basic construction is amenable to the use of several different types of material, such as heavy kraft paper, wax-coated paper, thin plastic or heavy-duty plastic, depending upon the desires of the manufacturer and the desired level of retail cost. The container, when sealed, is weatherproof to protect the contents against dust or rain. The container has many uses such as a sealed traveler's bag, (a broken seal indicating unauthorized entry), a shopping bag, a gift container, or, if insulating materials are used, an insulated, sealed container for hot foods or the like. Another advantage of the present invention is that where it assumes a generally flat, low-volume position when not in use, it has a relatively large capacity when used to carry items. As indicated, depending upon the materials which are used, its ability to withstand wear and tearing is limited only by the materials which a manufacturer desires to incorporate into the container.

Other features and advantages of the present invention will be apparent to persons skilled in the art from the following detailed description of a preferred embodiment accompanied by the attached drawing wherein identical reference numerals will refer to like parts in the various views.

THE DRAWING

DETAILED DESCRIPTION

Figure 1:
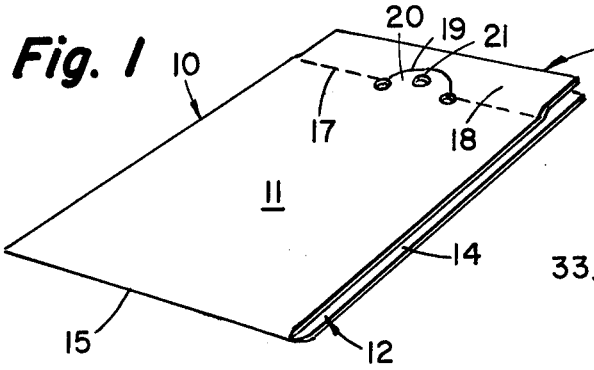
FIG. 1 is a perspective view of a folded bag prior to incorporation into the present invention.
Figure 2:
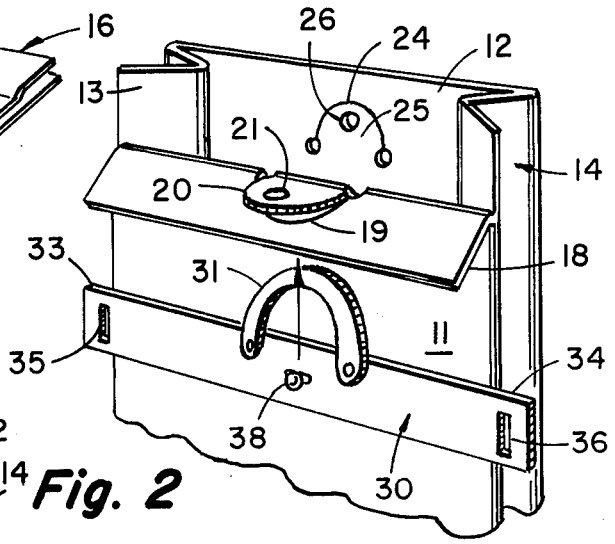
FIGS. 2–5 are fragmentary upper perspective views of the upper portion of the container illustrating the attachment of the stiffener member thereto.

Referring first to FIG. 1, reference numeral 10 generally designates a flexible bag having generally flat front and back panels 11 and 12, together with first and second pleated sides 13 (see FIG. 2) and 14, and a bottom 15 formed by heat sealing the front and back panels together. This construction provides a flat bottom when the bag is filled. The bag is closed except for an open top generally designated 16. The upper portion of the front panel 11 (that is, the portion above the dashed line 17) is designated 18, and it forms a foldable portion since its edges are not secured to the associated portions of the pleated sides 13, 14, as best illustrated in FIG. 2. A die-cut 19 of semi-circular shape is formed in the flap 18, and the lower portions of the die-cut are formed into round apertures to prevent further tearing. The die-cut 19 forms a tab 20, at the center of which there is provided an aperture 21, the function of which will be further discussed presently.

Referring now to FIG. 2, a similar semi-circular die-cut 24 is formed on the back panel 12 in register with the die-cut 19 to define a tab 25 which is apertured at 26.

A stiffener member generally designated 30 is in the form of an elongated, generally flat element; and it includes a handle 31 which may be riveted or otherwise attached to the stiffener element 30. The length of the stiffener element 30 is such as to extend beyond both edges of the front panel 11 of the bag, thereby defining first and second extensions 33, 34. These extensions are slotted respectively at 35, 36, which slots are also located beyond the edges of the front panel 11. At the center of the stiffener member 30 there is a stud 38 having a rounded head or bead which is adapted to fit through the apertures 21, 26 in a manner to be disclosed presently.

Figure 4:
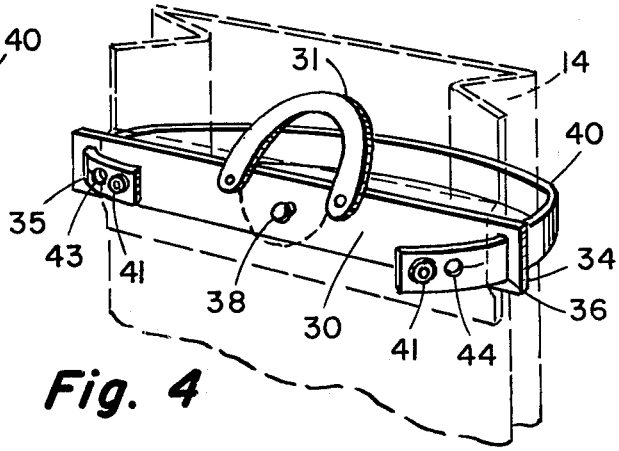
Figure 5:
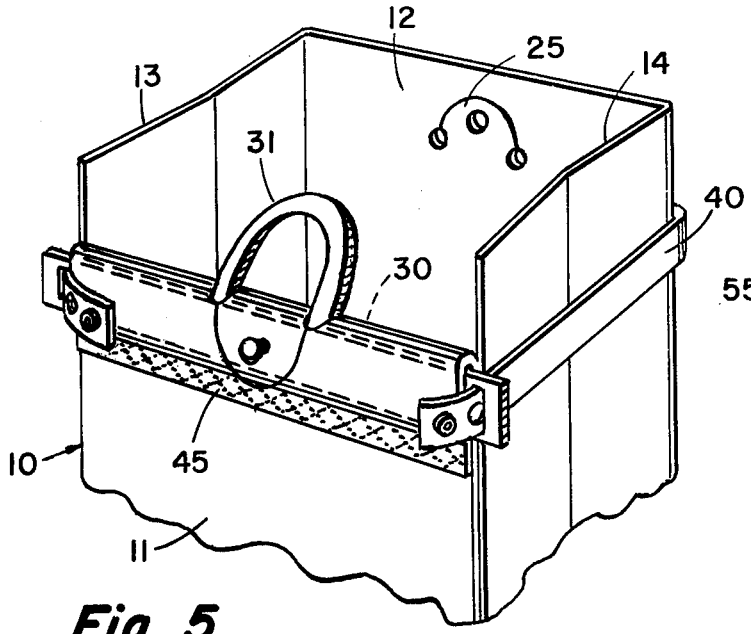

Referring now to FIGS. 4 and 5, a flexible band or belt generally designated 40 extends around the mouth 16 of the bag, and in cooperation with the stiffener member 30 completely encompasses the mouth of the bag. The free ends of the band 40 are fitted through the slots 35, 36 in the extensions of the stiffener member. Each end of the band 40 is provided with protrusions 41 which retain the ends of the band in the slots and prevent their accidental withdrawal. Further, the ends of the band are apertured at 43 and 44 respectively.

Figure 3:
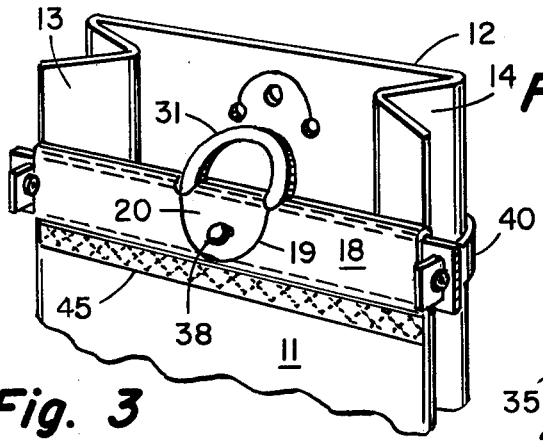

Referring now to FIGS. 2 and 3, the stiffener member 30 is assembled to the bag by inserting it in the direction of the arrow shown in FIG. 2 so that the handle 31 extends through the die-cut 19 in the flap 18. The lower ends of the handle 31 are thus received in the circular apertures at the lower ends of the die-cut 19, as best seen in FIG. 3; and the flap 18 is folded over the stiffener member. The flap 18 is long enough to extend beneath the stiffener member, and it is secured to the front panel 11 by gluing along the marginal edge as at 45 in FIG. 3. The aperture 21 of the tab 20 is then fitted over the beaded stud 38 on the stiffener member. Thus, the stiffener member 30 is attached to the front panel of the bag and spaced from its mouth beneath a foldable upper portion of the bag comprising the upper portions of the pleats 13, 14 and the rear panel 12.

As best illustrated in FIG. 5, in order to place items in the container, it may be held by the handle 31 so that the stiffener member 30 acts to stiffen the upper portion of the front panel 11 and thereby hold the mouth of the bag opened while the band 40 may be sized to limit the extent of the opening and thereby prevent tearing of the bag. As will be better understood from a complete description of the invention, the stiffener element 30 further acts to completely stiffen the top of the bag after it is sealed and secured, for transporting or carrying the container, and this facilitates carrying heavier items.

Figure 6:
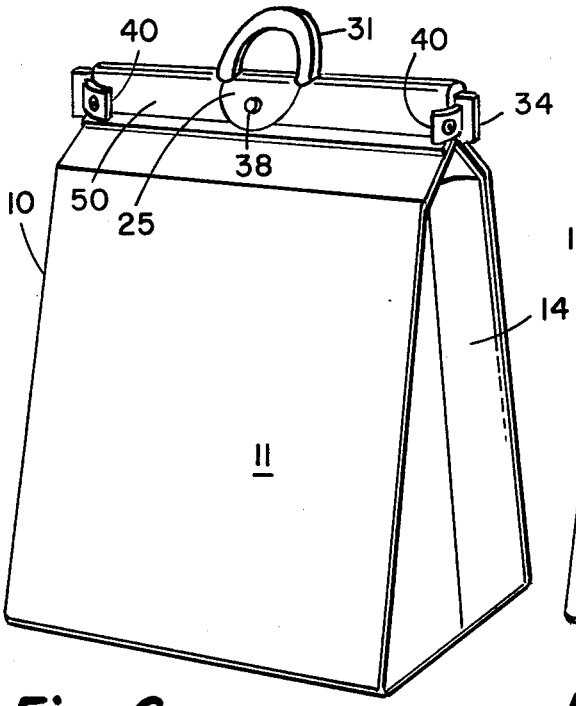
FIGS. 6–9 are upper perspective views of the assembled container showing closing, sealing and securing in the use position.
Figure 7:
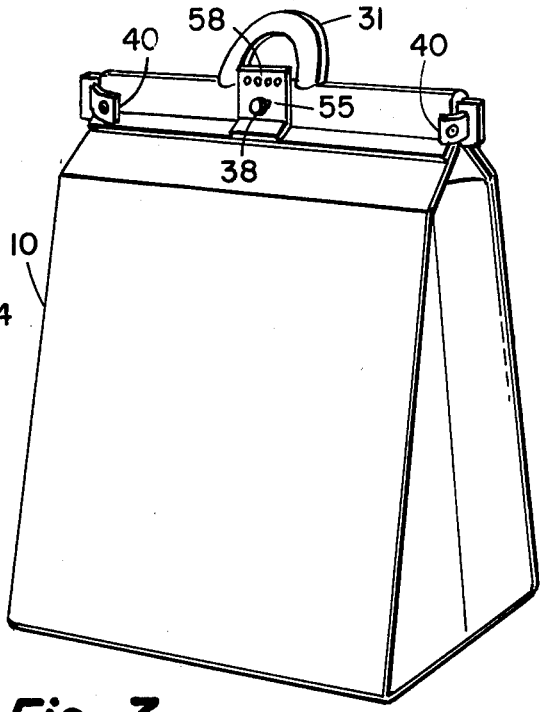

Referring now to FIG. 6, after the contents are placed in the container, the upper foldable portion of the bag just described is folded over the top of the stiffener member 30, as at 50 in FIG. 6, with the handle 11 extending through the die-cut 24, and the tab 25 on the back panel 12 placed beneath the handle 11 and over the beaded stud 38. Thus, the container is closed.

Figure 10:
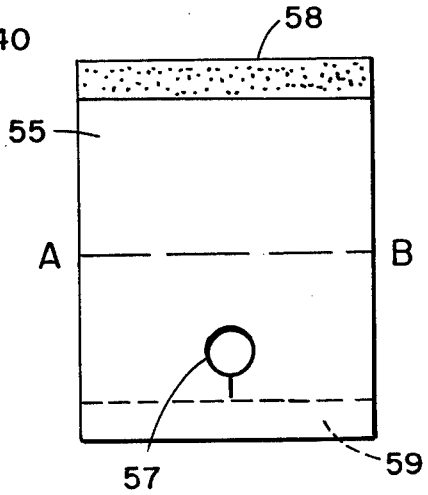
FIG. 10 is an elevational view of a seal which may be used to detect unauthorized entry into the container.

If it is desired to place a seal on the container, a seal such as a piece of paper shown at 55 in FIG. 10 with an aperture 57 may be used. One marginal edge of the seal 55 is provided with an adhesive as at 58, adapted to be placed adjacent and secured to the opposing marginal edge 59 when the seal 55 is folded along the dashed line A–B. The seal 55 is placed over the beaded stud 38 by means of the aperture 57 so that the glue line 58 extends above the stiffener member 30.

Figure 8:
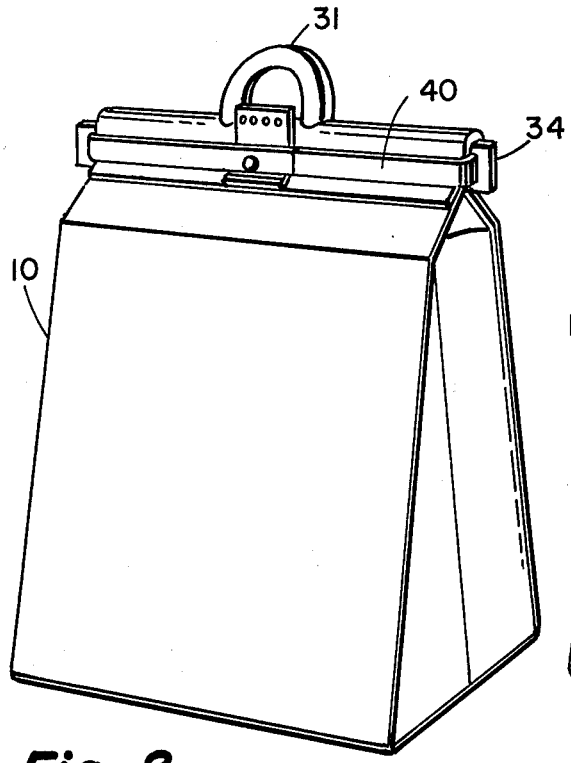
Figure 9:
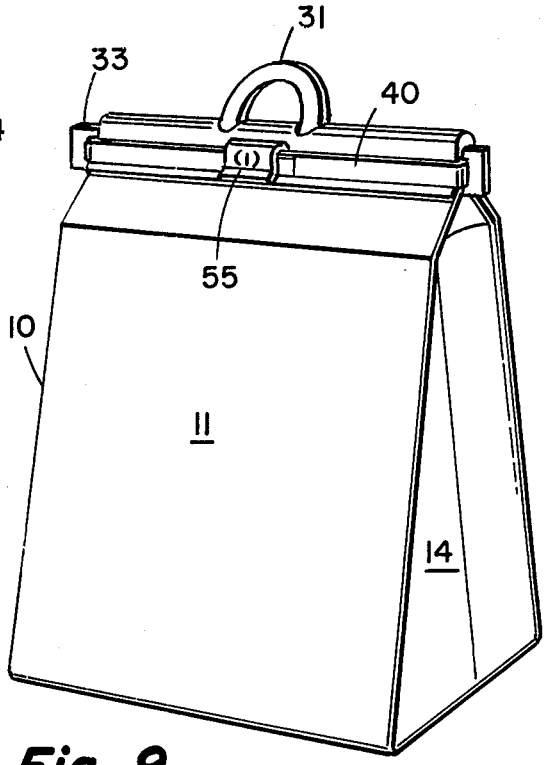

Next, the band 40 is drawn about the folded upper portion of the bag and both ends of the band 40 are attached to the weld stud 38 by means of the apertures 43, 44, as seen in FIG. 8. This seals the container after it is closed. Finally, the security seal 55 is folded and glued together as seen in FIG. 9 so that the bag cannot be opened without breaking the security seal and thereby render the unauthorized opening easily detectable. In this position, the handle 31 is readily accessible, there are no loose ends in the container, and it is completely closed, sealed and secured. As indicated, a wide range of materials may be used for the various elements disclosed, depending upon the intended use.

Having thus disclosed in detail a preferred embodiment of the invention, persons skilled in the art will be able to modify certain of the structure which has been illustrated, or to substitute equivalent elements for those disclosed while continuing to practice the principle of the invention, and it is therefore, intended, that all such modifications and substitutions be covered as they are embraced within the spirit and scope of the appended claims.

I claim:

1. A sealable container comprising a bag having generally flat front and back panels and first and second pleated sides joining said front and back panels together and cooperating therewith to define an open mouth; an elongated stiffener member attached to said front panel and spaced from said mouth beneath a foldable upper portion of said bag and defining first and second extensions extending laterally beyond said front panel, each extension defining a slot; a flexible band extending about said back panel and said pleated sides and having its ends extending through said slots of said band extensions; and lock means for securing said band to said stiffener member; whereby said pleats may be folded to close the mouth of said bag, said upper foldable portion may be folded over said stiffener member to seal said bag, and the free ends of said band may be drawn around the folded portion of said bag and attached to said lock means to secure said bag.

2. The apparatus of claim 1 further comprising a handle attached to said stiffener means.

3. The apparatus of claim 2 wherein the upper portion of said front panel of said bag is folded over said stiffener means and secured to said front panel to hold said stiffener means, the folded portion defining a die-cut tab extending within said handle and secured to said lock means.

4. The apparatus of claim 3 wherein said back panel is also die-cut to define a tab for receiving said handle when the upper portion thereof is folded over said stiffener means, said tab extending beneath said handle and secured to said lock means for sealing said bag.

5. The apparatus of claim 1 wherein said lock means comprises a beaded stud projecting laterally of said stiffener means.

6. The apparatus of claim 1 further comprising a foldable security seal adapted to be attached to said lock means before said band is drawn, and adapted to be sealed to itself after said band is drawn and connected to said lock means, thereby to prevent re-entry into the secured bag without breaching said security seal.

7. The apparatus of claim 1 wherein said front panel defines a loose foldable flap at the upper edge thereof, said flap defining a curved die-cut portion to provide a tab, the ends of the die-cut portion defining openings; a handle on said stiffener means and adapted to be received in the openings of said die-cut portion of said flap, the tab of said flap extending through said handle and secured to said lock means; the distal edge of said flap being secured to said front panel beneath said stiffener means.

* * * * *